US011719419B1

(12) United States Patent
Li et al.

(10) Patent No.: US 11,719,419 B1
(45) Date of Patent: Aug. 8, 2023

(54) DEFORMABLE LIGHT EMITTING DIODE (LED) LAMP CONFIGURED TO CHANGE LIGHT EMITTING ANGLE BY FOLDING

(71) Applicant: Xiamen Longstar Lighting Co., Ltd., Fujian (CN)

(72) Inventors: Xilong Li, Fujian (CN); Li Wei, Fujian (CN); Zengjun He, Fujian (CN); Cheng Zhang, Fujian (CN)

(73) Assignee: Xiamen Longstar Lighting Co., Ltd., Fujian (CN)

( * ) Notice: Subject to any disclaimer, the term of this patent is extended or adjusted under 35 U.S.C. 154(b) by 0 days.

(21) Appl. No.: 17/982,549

(22) Filed: Nov. 8, 2022

(51) Int. Cl.

| | |
|---|---|
| ***F21V 19/02*** | (2006.01) |
| ***F21S 4/28*** | (2016.01) |
| ***F21V 19/00*** | (2006.01) |
| ***F21V 14/02*** | (2006.01) |
| ***F21V 21/30*** | (2006.01) |
| ***F21V 23/04*** | (2006.01) |
| ***F21Y 115/10*** | (2016.01) |
| ***F21Y 103/10*** | (2016.01) |

(52) U.S. Cl.
CPC ..... *F21V 19/02* (2013.01); *F21S 4/28* (2016.01); *F21V 14/02* (2013.01); *F21V 19/001* (2013.01); *F21V 21/30* (2013.01); *F21V 23/04* (2013.01); *F21Y 2103/10* (2016.08); *F21Y 2115/10* (2016.08)

(58) Field of Classification Search
CPC ..... F21V 19/02; F21V 14/02; F21V 21/30; F21V 23/04
See application file for complete search history.

(56) References Cited

U.S. PATENT DOCUMENTS

| | | | | |
|---|---|---|---|---|
| 9,205,774 | B2 * | 12/2015 | Kennemer | F21L 14/00 |
| 11,480,318 | B1 * | 10/2022 | Xu | F21V 19/02 |
| 2008/0089071 | A1 * | 4/2008 | Wang | F21V 29/763 362/294 |
| 2009/0141494 | A1 * | 6/2009 | Zhang | F21V 29/73 362/373 |
| 2009/0168422 | A1 * | 7/2009 | Chiu | F21V 21/30 362/249.03 |
| 2013/0271993 | A1 * | 10/2013 | Jan | F21V 14/02 362/249.1 |
| 2018/0202639 | A1 * | 7/2018 | Kao | F21V 21/30 |
| 2022/0170614 | A1 * | 6/2022 | Kaye | F21S 2/005 |

FOREIGN PATENT DOCUMENTS

CN 215808082 U 2/2022

* cited by examiner

*Primary Examiner* — William N Harris
(74) *Attorney, Agent, or Firm* — Cooper Legal Group, LLC

(57) ABSTRACT

A deformable LED lamp configured to change a light emitting angle by folding comprises a fixed light source, one or more movable light sources, and an end cover. The one or more movable light sources are rotatably connected to the end cover through a rotating shaft, and the one or more movable light sources are configured to rotate about the rotating shaft to change an included angle between the fixed light source and the one or more movable light sources. One side of a LED light source board facing away from a light emitting surface of the LED light source board is connected with a heat sink to enable heat conduction between the LED light source board and the heat sink. The heat sink of the fixed light source and the heat sink of the one or more movable light sources are rotatably connected together through a hinge.

7 Claims, 6 Drawing Sheets

DEFORMABLE LIGHT EMITTING DIODE (LED) LAMP CONFIGURED TO CHANGE LIGHT EMITTING ANGLE BY FOLDING

FIELD OF THE DISCLOSURE

The present disclosure relates to a lighting device, in particular to a light emitting diode (LED) lamp.

BACKGROUND OF THE DISCLOSURE

At present, a structure of a lamp product on the market is still basically in a state that a light-emitting angle is not adjustable and a range of an effective irradiation area is fixed and unchangeable. Lighting requirements cannot be met along with the increasing promotion of energy conservation and emission reduction.

BRIEF SUMMARY OF THE DISCLOSURE

The present disclosure provides a deformable LED lamp configured to change a light emitting angle by folding, so that a defect of a light-emitting angle of shop lamp products is overcome, a light-emitting surface is adjusted according to requirements of users, and a space area can be illuminated more brightly under a same space condition.

In order to solve the technical problem, a technical solution of the present disclosure is as follows. A deformable LED lamp configured to change a light emitting angle by folding comprises a fixed light source, one or more movable light sources, and an end cover. The one or more movable light sources are rotatably connected to the end cover through a rotating shaft, and the one or more movable light sources are configured to rotate about the rotating shaft to change an included angle between the fixed light source and the one or more movable light sources. Each of the fixed light source and the one or more movable light sources comprises an LED light source board and a heat sink. One side of the LED light source board facing away from a light emitting surface of the LED light source board is connected with the heat sink to enable heat conduction between the LED light source board and the heat sink. The heat sink of the fixed light source and the heat sink of the one or more movable light sources are rotatably connected together through a hinge.

In a preferred embodiment, the one or more movable light sources are configured to rotate to alternatively be in a first position, a second position, or a third position with respect to the fixed light source. When in the second position, the fixed light source and the one or more movable light sources are positioned on a same horizontal plane. The first position is a position in which the one or more movable light sources have been rotated clockwise with respect to the second position, and the third position is a position in which the one or more movable light sources have been rotated counter-clockwise with respect to the second position.

In a preferred embodiment, the one or more movable light sources are two movable light sources, and the two movable light sources are respectively disposed on two sides of the fixed light source spaced apart from each other in a width direction of the fixed light source.

In a preferred embodiment, each of the fixed light source and the one or more movable light sources comprises a lamp cover, and the LED light source board is disposed in the lamp cover.

In a preferred embodiment, the end cover comprises a first end cover and a second end cover, and the first end cover and the second end cover are fixedly connected together through a buckle structure and a first bolt to enable a switch to be clamped therebetween.

In a preferred embodiment, the second end cover and a rotating shaft end cover are fixedly connected together through a second bolt.

In a preferred embodiment, the second end cover comprises a semi-arc shaped positioning groove for limiting a maximum angle of clockwise rotation of the rotating shaft end cover relative to the fixed light source.

In a preferred embodiment, the rotating shaft end cover is fixedly connected to the lamp cover of the one or more movable light sources.

Compared with the existing techniques, the technical solution has the following advantages.

1. The present disclosure provides a deformable LED lamp configured to change a light emitting angle by folding, which comprises a lighting member comprising four light sources. One or more movable light sources are turned over up and down through a coaxial principle of a rotating shaft end cover and a hinge, so that the one or more movable light sources on two sides are turned over up and down, thereby making a light emitting angle of the one or more movable light sources expand from 120 degrees (i.e., a light emitting angle of a lamp on the market) to 300 degrees, and light rays are emitted by light sources (i.e., the one or more movable light sources) and pass through a lamp shade to be emitted to a work space so as to avoid diffuse reflection of the light rays or multiple refractions of the light rays. A loss of the light rays has been reduced, thereby the work space is effectively illuminated to a greater extent. The work space that originally probably needs many lamps to achieve illumination does not need the original number of lamps, which can effectively improve energy-conserving effect.

2. The present disclosure provides a deformable LED lamp configured to change a light emitting angle by folding, which is assembled through buckle structures to achieve assembly to make the assembly quick and easy when the factory produces products and greatly reduces the production labor cost and management cost.

3. The present disclosure provides a deformable LED lamp configured to change a light emitting angle by folding, which is made of an SPCC cold-rolled sheet material, so that heat dissipation efficiency of the light sources and a power supply drive is improved while the stability and firmness of the product structure are ensured, and the service life of the whole lamp is longer.

DETAILED DESCRIPTION OF THE EMBODIMENTS

Figure 1:
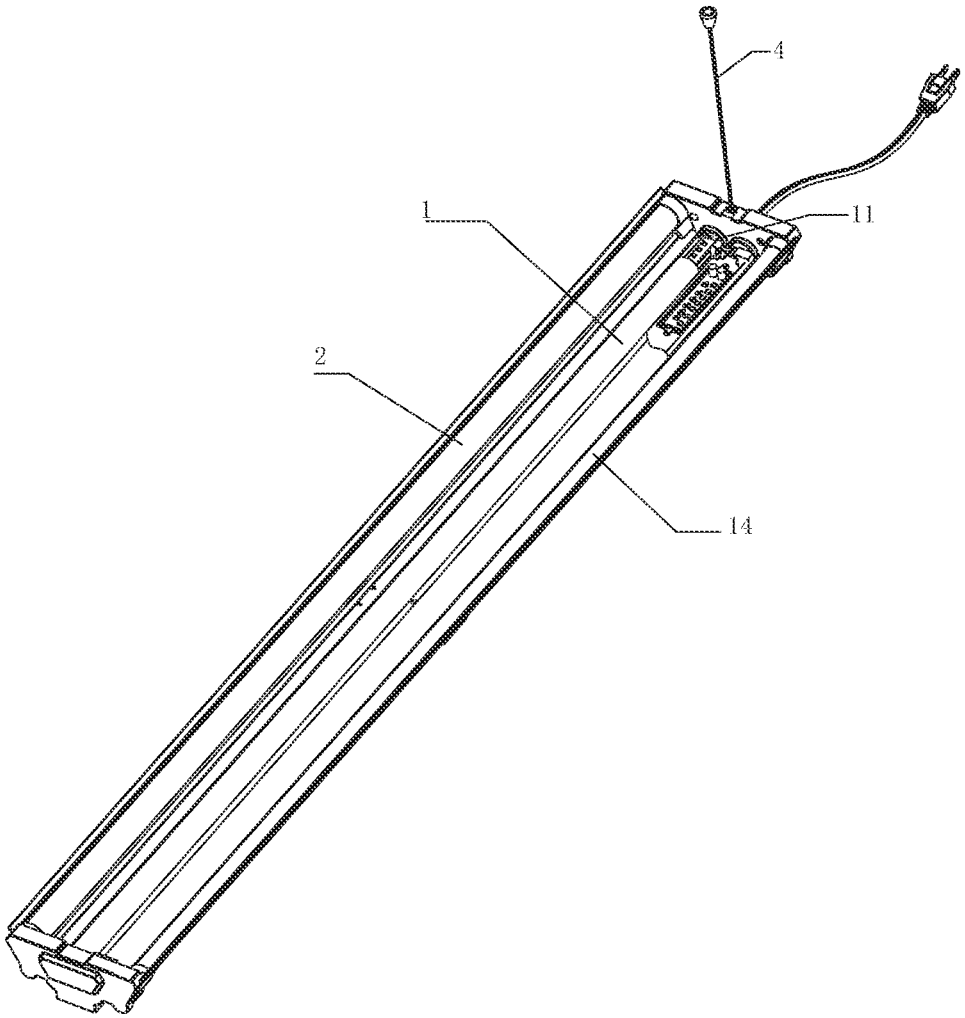
FIG. 1 illustrates a front perspective view of a deformable LED lamp of a preferred embodiment in the present disclosure.

The present disclosure will be further described below in combination with the accompanying drawings and embodiments.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the referenced device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
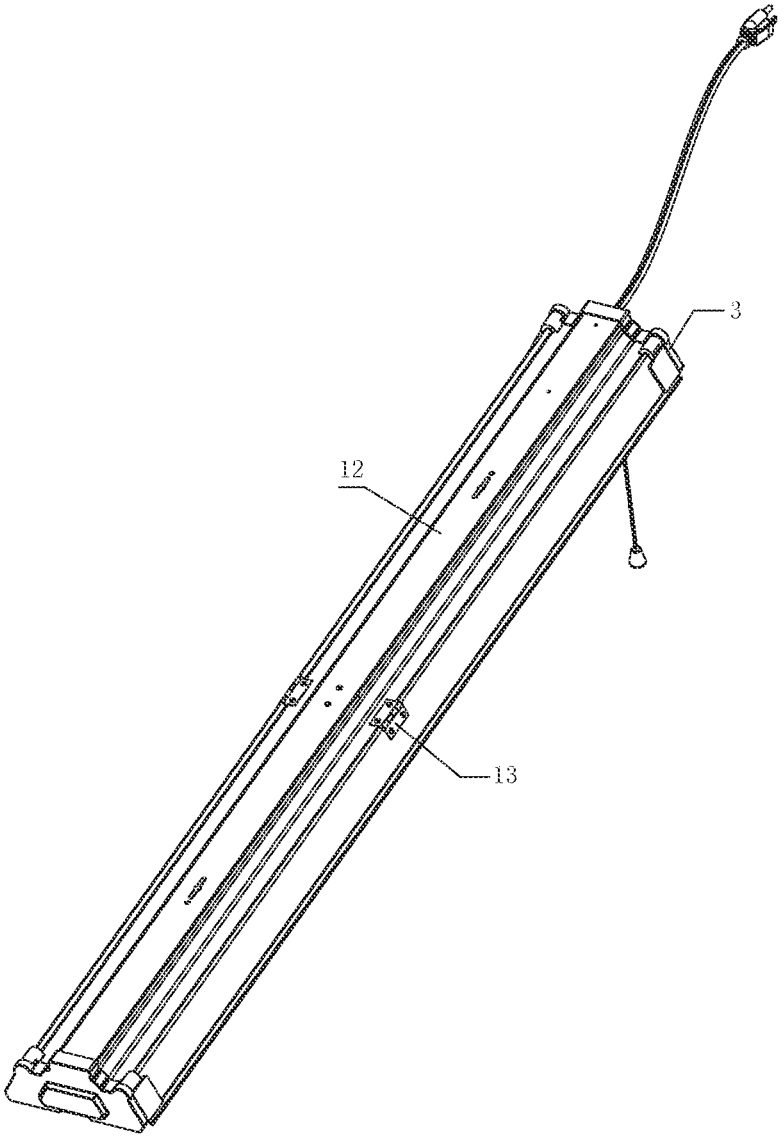
FIG. 2 illustrates a rear perspective view of the deformable LED lamp of a preferred embodiment in the present disclosure.
Figure 3:
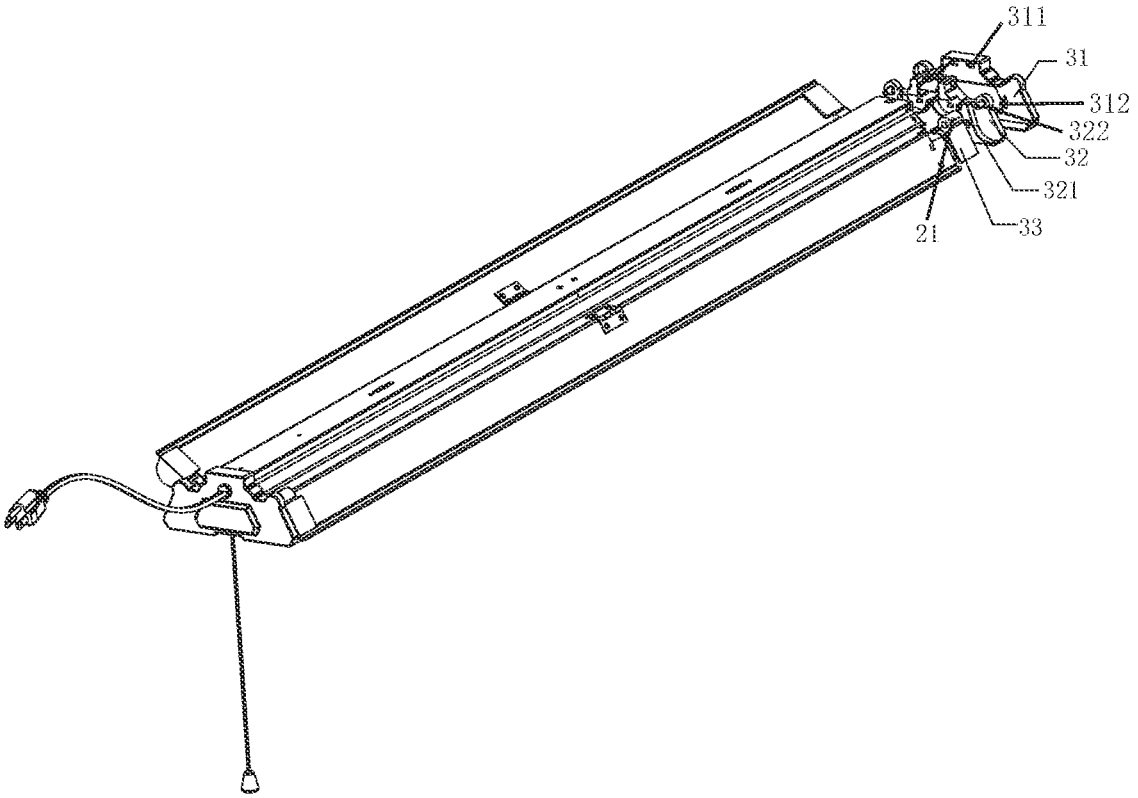
FIG. 3 illustrates a partial exploded view of the deformable LED lamp of a preferred embodiment in the present disclosure.
Figure 4:
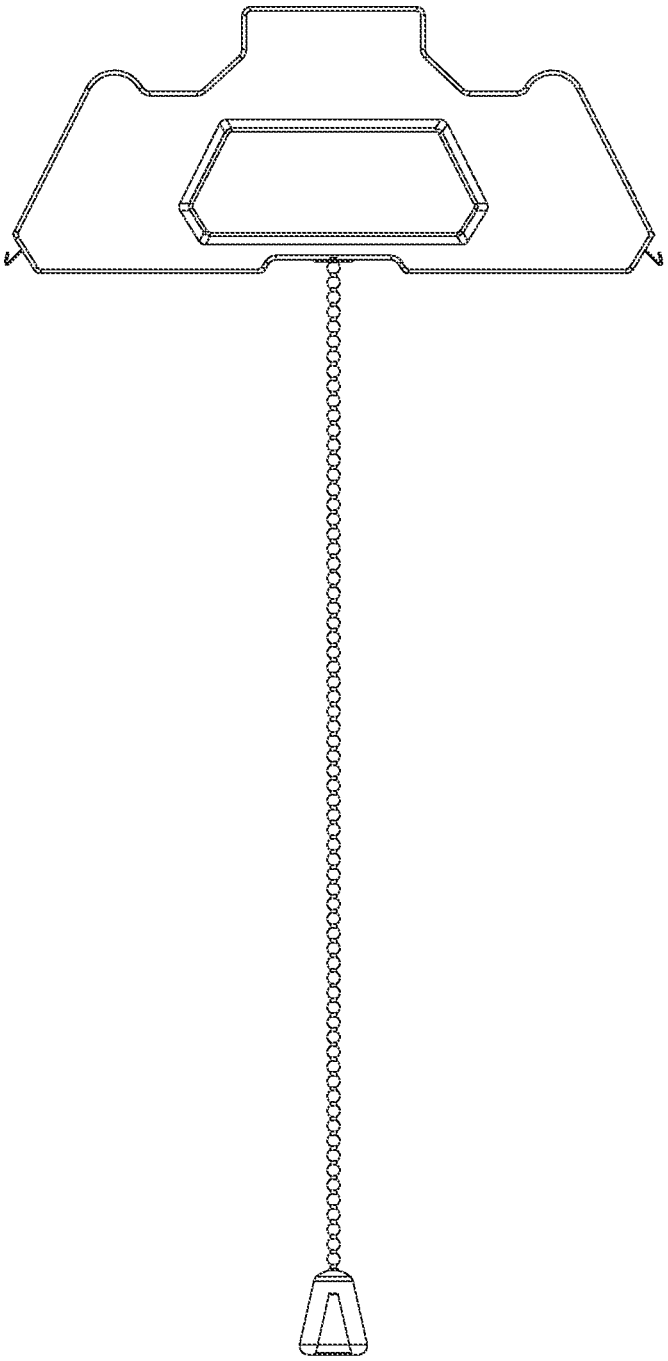
FIGS. 4-6 illustrate various side views of one or more movable light sources of a preferred embodiment in the present disclosure.
Figure 5:
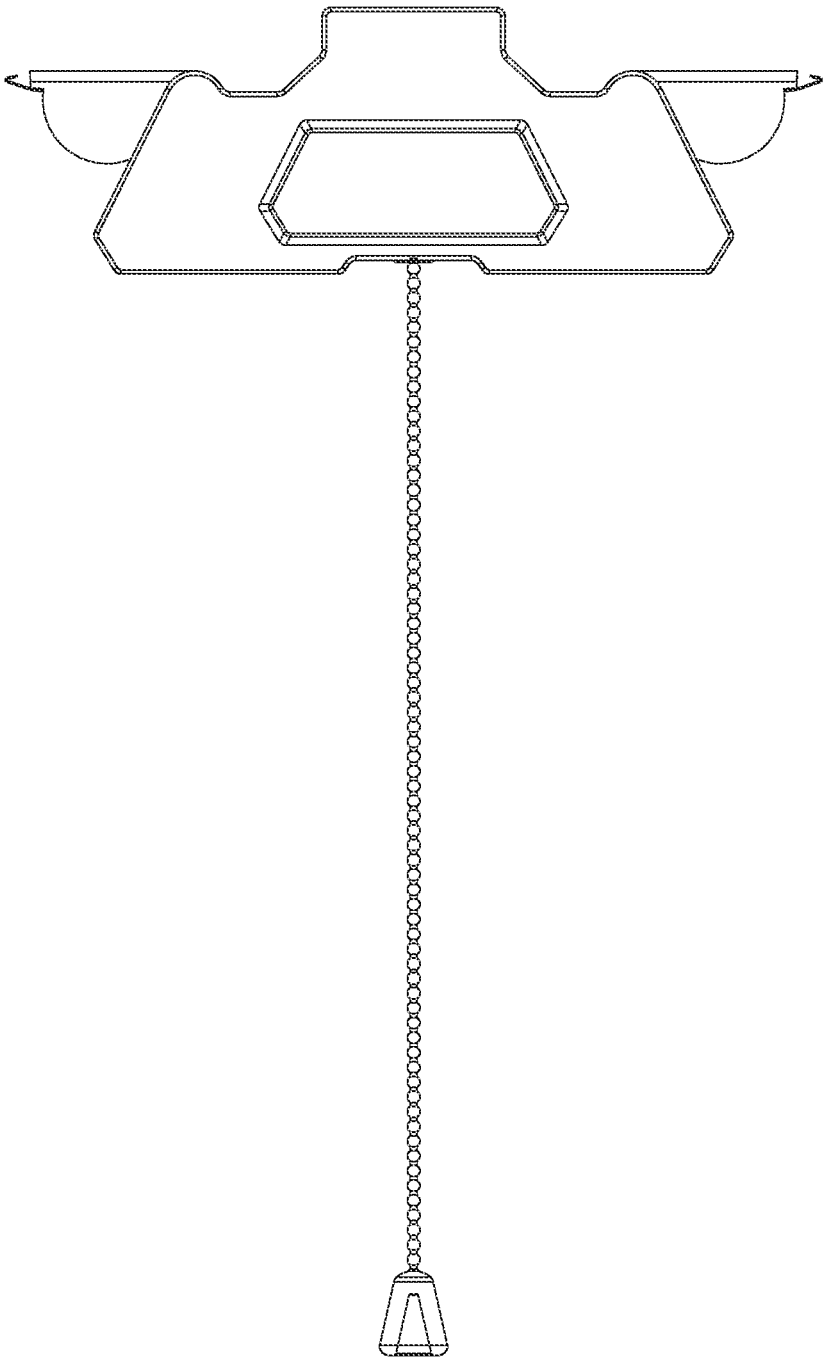
Figure 6:
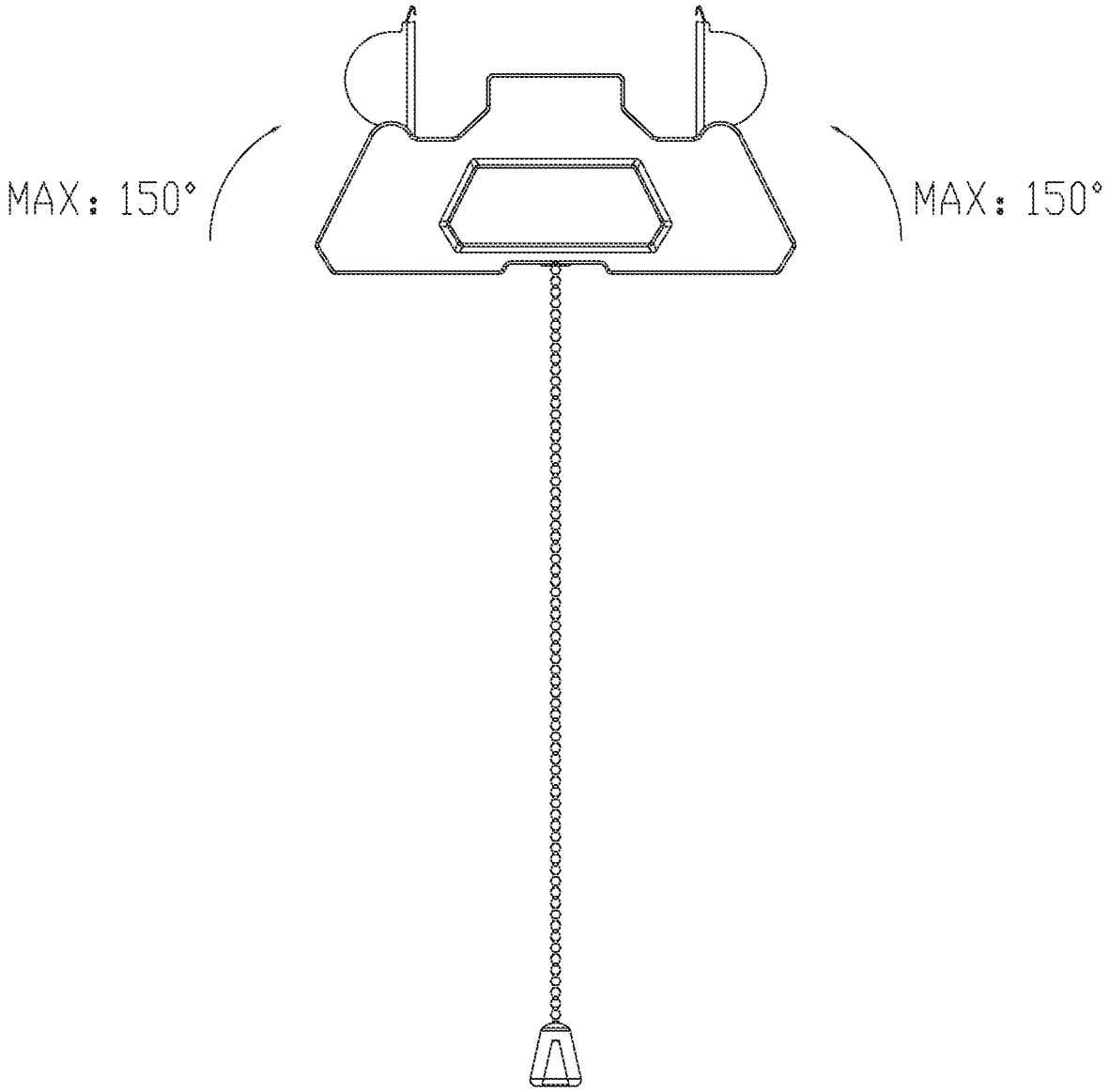

Referring to FIGS. 1 to 6, the present disclosure provides a deformable light emitting diode (LED) lamp configured to change a light emitting angle by folding, and the deformable LED comprises a fixed light source 1, one or more movable light sources 2, and an end cover 3.

The one or more movable light sources 2 are rotatably connected with the end cover 3 through a rotating shaft 21, so that the one or more movable light sources 2 are configured to rotate about the rotating shaft 21 to change an included angle between the fixed light source 1 and the one or more movable light sources 2.

Each of the fixed light source 1 and the one or more movable light sources 2 comprises an LED light source board 11 and a heat sink 12. One side of the LED light source board 11 facing away from a light emitting surface of the LED light source board 11 is connected with the heat sink 12 in a manner that enables heat conduction between the LED light source board 11 and the heat sink 12. The heat sink 12 of the fixed light source 1 and the heat sink(s) 12 of the one or more movable light sources 2 are rotatably connected together through a hinge 13.

In this embodiment, the one or more movable light sources 2 are two movable light sources 2, and the two movable light sources 2 are respectively disposed on two sides of the fixed light source 1 along a width direction of the fixed light source 1. Alternatively, the one or more movable light sources 2 are a single movable light source 2, and the single movable light source 2 is disposed on one side of the fixed light source 1, which is a simple alternative to this illustrated embodiment and will not be described again.

In the present embodiment, the two movable light sources 2 are configured to rotate to alternatively be in a first position, a second position, or a third position with respect to the fixed light source 1. In the second position, the fixed light source 1 and the two movable light sources 2 are positioned on a same horizontal plane. The first position is a position in which the two movable light sources 2 have been rotated clockwise with respect to the second position. The third position is a position in which the two movable light sources 2 have been rotated counterclockwise with respect to the second position. Therefore, the two movable light sources 2 on the two sides of the fixed light source 1 achieve an upper angle rotation and a lower angle rotation, thereby making a light emitting angle of the two movable light sources 2 expand from 120 degrees (i.e., a light emitting angle of a lamp on the market) to 300 degrees, and light rays are emitted by light sources (i.e., the two movable light sources 2) and pass through a lamp shade to be emitted to a work space so as to avoid diffuse reflection of the light rays or multiple refractions of the light rays. Additionally, a loss of the light rays has been reduced, thereby the work space is effectively illuminated to a greater extent. The work space that originally probably needs many lamps to achieve illumination does not need the original number of lamps, which can effectively improve energy-conserving effect.

Specifically, each of the fixed light source 1 and the one or more movable light sources 2 further comprises a lamp cover 14, and the LED light source board 11 is disposed in the lamp cover 14.

For mounting a switch 4, the end cover 3 comprises a first end cover 31 and a second end cover 32, and the first end cover 31 and the second end cover 32 are fixedly connected together through a buckle structure 311 and a first bolt 312 to enable the switch 4 to be clamped therebetween. Therefore, a user can trigger the switch 4 by pulling a rope, and an operation of turning on and off the deformable lamp is realized.

In addition, in order to realize a rotation effect of the rotating shaft 21, the second end cover 32 and a rotating shaft end cover 33 are fixedly connected together through a second bolt 322. The second end cover 32 comprises a semi-arc shaped positioning groove 321 for limiting a maximum angle of clockwise rotation of the rotating shaft end cover 33 relative to the fixed light source 1.

Finally, in order to enable a connection between the rotating shaft 21 and the two movable light sources 2, the rotating shaft end cover 33 is fixedly connected to the lamp cover 14 of the two movable light sources 2.

The deformable LED lamp adopts buckle structures to achieve assembly to make the assembly quick and easy when the factory produces products and greatly reduces the production labor cost and management cost. The heat sink 12 is made of SPCC cold-rolled sheet material, so that stability and firmness of the product structure are ensured, and meanwhile, radiating efficiency of the light sources and the power supply is improved, so that the service life of the whole lamp is longer.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A deformable light emitting diode (LED) lamp configured to change a light emitting angle by folding, comprising:

a fixed light source, one or more movable light sources, and an end cover, wherein:

the one or more movable light sources are rotatably connected to the end cover through a rotating shaft, the one or more movable light sources are configured to rotate about the rotating shaft to change an included angle between the fixed light source and the one or more movable light sources, each of the fixed light source and the one or more movable light sources comprises an LED light source board and a heat sink, one side of the LED light source board facing away from a light emitting surface of the LED light source board is connected with the heat sink to enable heat conduction between the LED light source board and the heat sink, the heat sink of the fixed light source and the heat sink of the one or more movable light sources are rotatably connected together through a hinge, the end cover comprises a first end cover and a second end cover, and the first end cover and the second end cover are fixedly connected together through a buckle structure and a first bolt to enable a switch for controlling the fixed light source and the one or more movable light sources to be clamped therebetween.

2. The deformable LED lamp configured to change the light emitting angle by folding according to claim 1, wherein:

the one or more movable light sources are configured to rotate to alternatively be in a first position, a second position, or a third position with respect to the fixed light source, when in the second position, the fixed light source and the one or more movable light sources are positioned on a same horizontal plane, the first position is a position in which the one or more movable light sources have been rotated clockwise with respect to the second position, and the third position is a position in which the one or more movable light sources have been rotated counterclockwise with respect to the second position.

3. The deformable LED lamp configured to change the light emitting angle by folding according to claim 1, wherein:

the one or more movable light sources are two movable light sources, and the two movable light sources are respectively disposed on two sides of the fixed light source spaced apart from each other in a width direction of the fixed light source.

4. The deformable LED lamp configured to change the light emitting angle by folding according to claim 1, wherein:

each of the fixed light source and the one or more movable light sources comprises a lamp cover, and the LED light source board is disposed in the lamp cover.

5. The deformable LED lamp configured to change the light emitting angle by folding according to claim 1, wherein:

the second end cover and a rotating shaft end cover are fixedly connected together through a second bolt.

6. The deformable LED lamp configured to change the light emitting angle by folding according to claim 5, wherein:

the second end cover comprises a semi-arc shaped positioning groove for limiting a maximum angle of clockwise rotation of the rotating shaft end cover relative to the fixed light source.

7. The deformable LED lamp configured to change the light emitting angle by folding according to claim 6, wherein:

the rotating shaft end cover is fixedly connected to a lamp cover of the one or more movable light sources.

* * * * *